US007365687B2

(12) United States Patent
Borleske et al.

(10) Patent No.: US 7,365,687 B2
(45) Date of Patent: Apr. 29, 2008

(54) ANTENNA WITH DISK RADIATOR USED IN AUTOMATIC METER READING (AMR) DEVICE

(75) Inventors: Andrew J. Borleske, Garner, NC (US); Mark R. Wolski, Cedarburg, WI (US); Charles Cunningham, Jr., Raleigh, NC (US); Garry M. Loy, Raleigh, NC (US)

(73) Assignee: Elster Electricity, LLC, Raleigh, NC (US)

( * ) Notice: Subject to any disclaimer, the term of this patent is extended or adjusted under 35 U.S.C. 154(b) by 0 days.

(21) Appl. No.: 11/408,565

(22) Filed: Apr. 21, 2006

(65) Prior Publication Data

US 2007/0247380 A1 Oct. 25, 2007

Related U.S. Application Data

(60) Provisional application No. 60/673,862, filed on Apr. 22, 2005.

(51) Int. Cl.
*H01Q 1/38* (2006.01)
*H01Q 1/04* (2006.01)

(52) U.S. Cl. ..... 343/700 MS; 343/719

(58) Field of Classification Search ..... 343/719, 343/700 MS, 846, 872; 340/870.02, 870.01
See application file for complete search history.

(56) References Cited

U.S. PATENT DOCUMENTS

| | | | | |
|---|---|---|---|---|
| 5,298,894 | A * | 3/1994 | Cerny et al. | 340/870.02 |
| 6,177,883 | B1 * | 1/2001 | Jennetti et al. | 340/870.02 |
| 6,300,907 | B1 * | 10/2001 | Lazar et al. | 343/700 MS |
| 6,812,902 | B2 * | 11/2004 | Rossman et al. | 343/725 |
| 6,819,292 | B2 * | 11/2004 | Winter | 343/702 |
| 2007/0018849 | A1 * | 1/2007 | Salser, Jr. | 340/870.02 |

* cited by examiner

*Primary Examiner*—Hoang V Nguyen
(74) *Attorney, Agent, or Firm*—Woodcock & Washburn LLP

(57) ABSTRACT

An antenna for use in an automatic meter reading (AMR) module comprises a pin and a radiator. The radiator may be a disk radiator for example, that comprises an opening which may receive the pin. Desirably, the pin is affixed to the radiator at one end, and is disposed on a ground plane at the other end. The antenna may be a top loaded short monopole antenna, for example. Additionally, the antenna may be used in a module for a water meter. The pin and disk radiator may be stamped from a single sheet of material.

17 Claims, 7 Drawing Sheets

ANTENNA WITH DISK RADIATOR USED IN AUTOMATIC METER READING (AMR) DEVICE

CROSS-REFERENCE TO RELATED APPLICATIONS

This application claims benefit under 35 U.S.C. 119(e) to provisional Application No. 60/673,862 filed on Apr. 22, 2005.

FIELD OF THE INVENTION

The present invention relates generally to the field of automatic meter reading (AMR) and, more particularly, to antennas and assemblies for use in an AMR system.

BACKGROUND OF THE INVENTION

AMR devices must be able to communicate in various unfriendly environments. For example, AMR devices for water meters must be able to communicate in the RF unfriendly environment of the iron water pit. Typically, this is accomplished by placing an antenna on top of the water pit lid, with the connection to the meter going through a hole in the lid. This allows a large antenna area, but the antenna often protrudes dangerously high above the lid, and requires a field-installed connection between the antenna and the water meter.

Another typical installation has the antenna protruding through a hole in the pit lid. This has the advantages of a low profile above the lid, and the connection from the antenna to the water meter can be made at the factory. The main drawback is that the entire antenna must be small enough to fit through a small hole in the lid, and cannot have much elevation above the lid.

In view of the foregoing, there is a need for systems and methods that overcome such deficiencies.

SUMMARY OF THE INVENTION

The following summary provides an overview of various aspects of the invention. It is not intended to provide an exhaustive description of all of the important aspects of the invention, nor to define the scope of the invention. Rather, this summary is intended to serve as an introduction to the detailed description and figures that follow.

The present invention is directed to an antenna that is used in an AMR module and comprises a pin and disk radiator. The antenna may be a top loaded short monopole antenna, for example. Additionally, the antenna may be used in a module for a water meter. The pin and disk radiator may be stamped from a single sheet of material.

An example antenna is provided that protrudes through the lid, but has the performance of an above the lid antenna. The antenna works well in an iron water pit, mounted through the pit lid, as well as in plastic pit lids and remote mounted boxes, for example.

Additional features and advantages of the invention will be made apparent from the following detailed description of illustrative embodiments that proceeds with reference to the accompanying drawings.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF ILLUSTRATIVE EMBODIMENTS

The present invention is directed to an antenna that can be used in an AMR module for a water meter, for example. The antenna may be used in an iron water pit, mounted through the pit lid, as well as in plastic pit lids and remote mounted boxes, for example.

Figure 1:
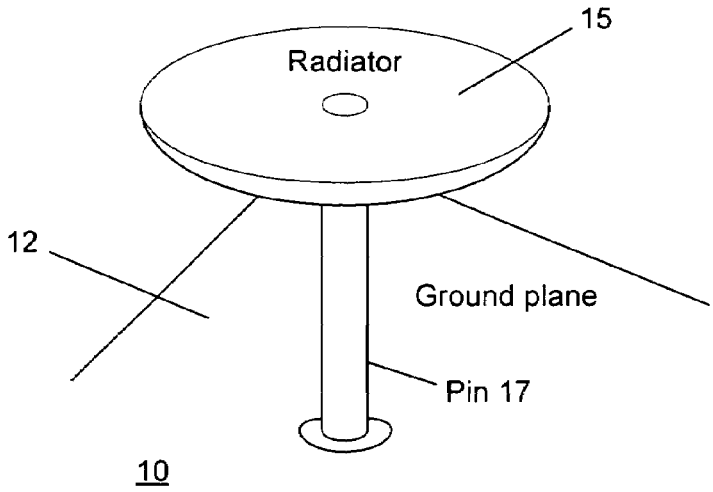
FIG. 1 is a perspective view diagram of an example antenna and ground plane.
Figure 2:
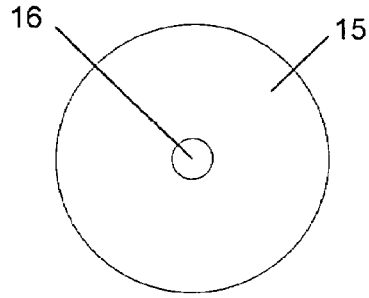
FIG. 2 is a top view diagram of an example radiator.

FIG. 1 is a perspective view diagram of an example antenna, and FIG. 2 is a top view diagram of an example antenna radiator. The antenna 10 comprises a pin 17 and a radiator 15 supported by the pin 17. The radiator 15 may be a disk radiator for example, that comprises an opening 16 which may receive the pin 17. Desirably, the pin 17 is affixed to the radiator 15 at one end, and is disposed on an RF feed point surrounded by a ground plane 12 at the other end.

According to an example, the antenna includes a solid pin 17 that is connected to an antenna disk radiator 15. Desirably, the pin 17 goes through the opening 16, but does not project beyond the back surface of the radiator 15. The pin 17 may be attached to the radiator 15 using any appropriate means, such as a tin/lead solder or a mechanically pressed connection, for example. The disk radiator 15 may comprise 0.025" brass sheet, C2600 alloy ¼-½ hard, for example, and may have a diameter of about 0.900". The pin 17 may have a diameter of 0.0785 inches, for example, and an opening 16 in the radiator 15 for the pin 17 may be made using a #47 drill, for example. The length of the pin 17 may be about 1.02 inches, for example. Other materials could be used to construct pin 17 and disk radiator 15 provided they are electrically conductive. Additionally, other sizes could be used to accommodate different RF frequencies and different mechanical packages.

The antenna may be a water module antenna for example, and may be used with Elster Electricity's REX™ metering system or other types of metering systems. The mounting configuration desirably allows the disk to protrude slightly above the level of the pit lid to provide a good radiation pattern. Additionally, the antenna desirably can be covered by an internal shield, for example, so that the entire assembly can be potted without degrading the performance of the antenna.

Because the antenna desirably contains its own ground plane and does not rely on the pit lid, it performs equally as well in a plastic lid (either mounted through a hole, or internally to the plastic lid, for example) or as a stand-alone product. Acting as a stand-alone product allows the module to be repackaged to mount to a wall or a meter itself without changing any of the internal hardware.

Figure 3:
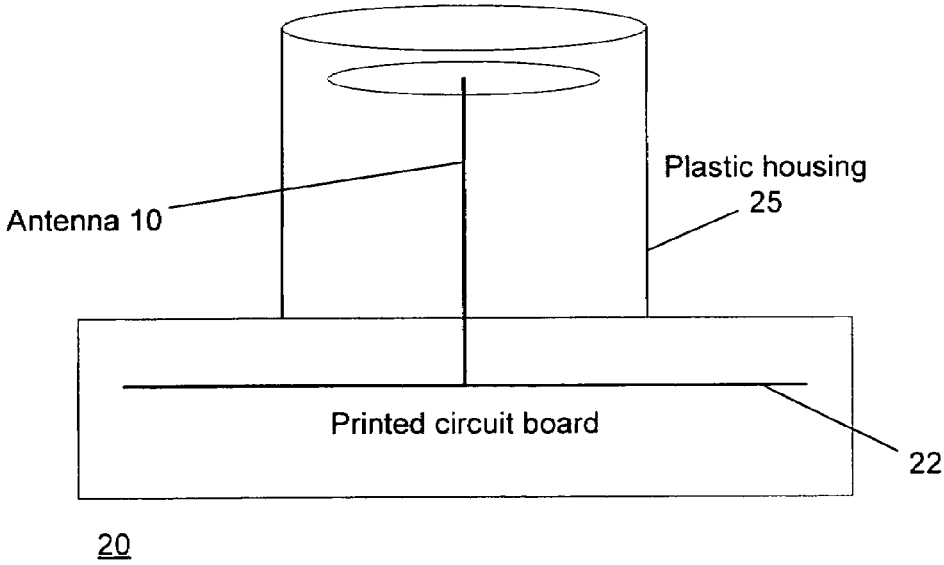
FIG. 3 is a side view diagram of an example mounted antenna assembly.

FIG. 3 is a side view diagram of an example mounted antenna assembly. The assembly 20 comprises an antenna, such as the antenna 10 of FIG. 1, mounted on a printed circuit board 22 and enclosed within a plastic housing 25.

The antenna 10 may be connected to the printed circuit board 22 via a soldered through-hole connection. Additionally, the antenna 10 may have a shoulder, or similarly functioning structure, on the bottom of the pin to hold the antenna in the proper orientation during the solder operation. The printed circuit board 22 may be connected to the plastic housing 25 using integrated plastic standoffs. The plastic housing 25 is desirably used as a mechanical mounting point for the printed circuit board 22 and antenna 10, as well as for environmental protection.

Figure 4:
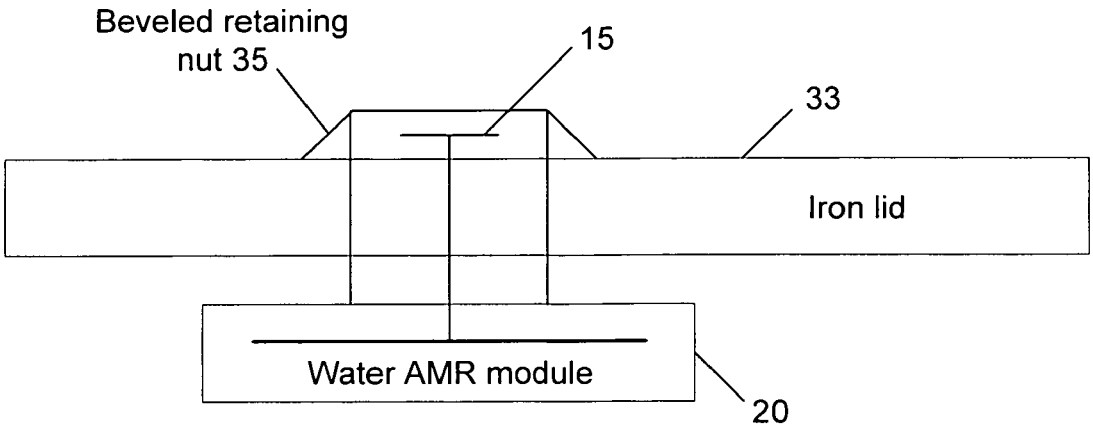
FIG. 4 is a side view diagram of an example AMR module mounted in an iron pit lid.

FIG. 4 is a side view diagram of an example AMR module mounted in an iron pit lid. A module, such as the assembly 20 of FIG. 2, is mounted to an iron lid 33 using a beveled retaining nut 35, for example. Here, the disk 15 may protrude slightly above the level of the lid 33.

In an example, the iron pit lid 33 has a 1⅞" hole that can either be cast when the lid is manufactured, or drilled as a retrofit of a standard lid. The beveled retaining nut 35 mechanically attaches the assembly 20 to the iron pit lid 33, and places the disk 15 in the desired location. The beveled retaining nut 35 protrudes minimally above the iron lid 33, and desirably has a shallow bevel around the perimeter to minimize tripping hazards when placed in a location subject to foot traffic.

Figure 5:
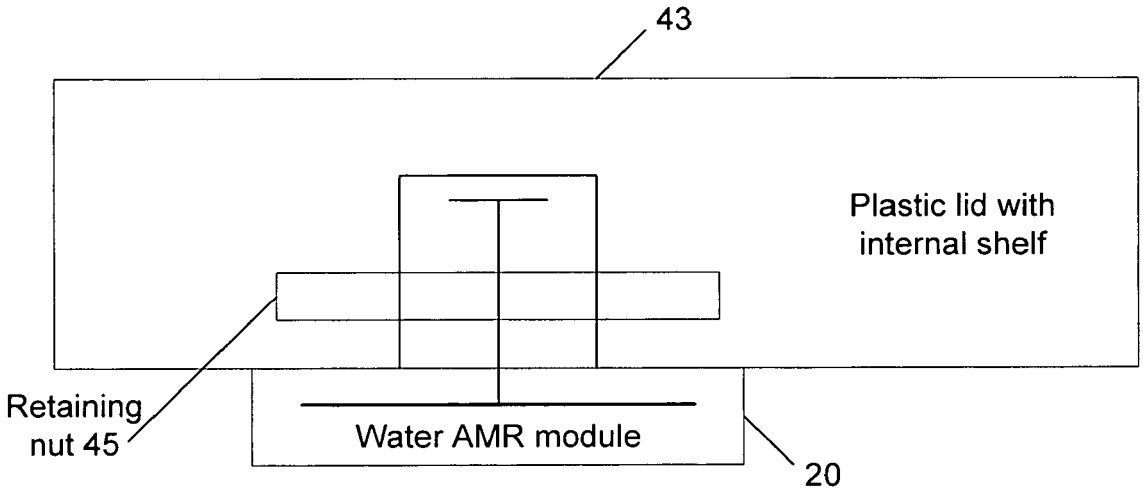
FIG. 5 is a side view diagram of an example AMR module mounted in a plastic pit lid.

FIG. 5 is a side view diagram of an example AMR module mounted in a plastic pit lid. A module, such as the assembly 20 of FIG. 2, may be mounted to a plastic lid 43 with an internal shelf using a retaining nut 45, for example.

The plastic lid 43 desirably comprises an electrically non-conductive material that minimally affects the transmission of radio frequency waves. This allows the disk 15 to be placed below the surface of the plastic lid 43 without adverse effects on the RF communications. The plastic lid 43 may be manufactured with a hollow area that is surrounded by a lip that acts as an internal shelf. This shelf allows AMR devices to be mechanically attached to the inside of the plastic lid 43. The retaining nut 45 may be used to mechanically attach the assembly 20 to this shelf.

Figure 6:
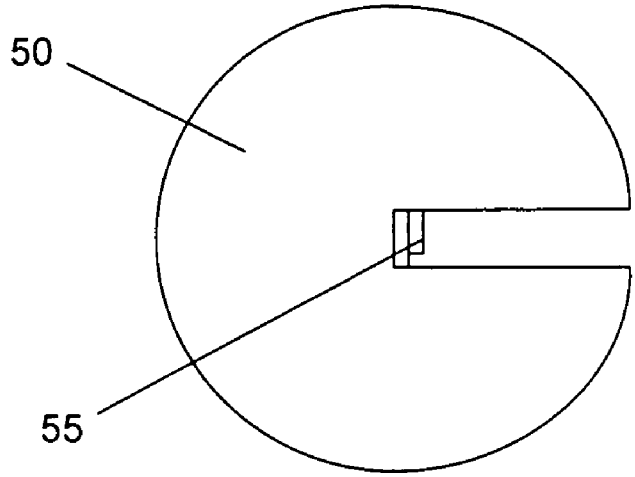
FIG. 6 is a top view diagram of another example antenna with radiator.
Figure 7:
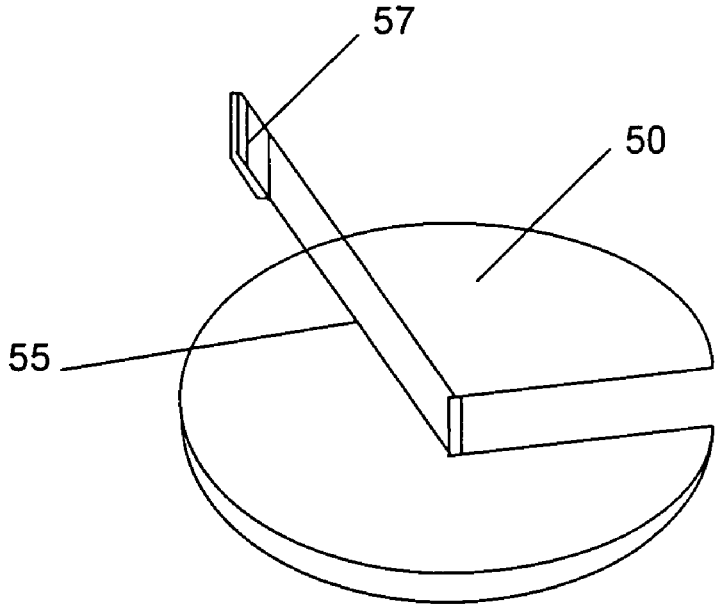
FIG. 7 is a perspective view diagram of another example antenna with radiator.

FIG. 6 is a top view diagram and FIG. 7 is a perspective view diagram of another example antenna with radiator. Like the antenna 10, the antenna of FIGS. 6 and 7 comprises a radiator and pin. In this example, however, the antenna comprises a radiator 50 and a pin 55 that are desirably stamped from a single sheet of material.

The material may be 0.025" brass sheet, alloy 26, ½ hard, for example. Other electrically conductive materials could be used, provided they could be stamped into this form. The length of the pin 55 may be about 1.02 inches, for example. The pin 55 may have a connector 57 at the end opposite the disk 50 for a mechanical and electrical connection to a printed circuit board, for example. Desirably, the stamped antenna shown in FIGS. 6 and 7 performs equivalently to the antenna shown in FIG. 1, and is less expensive and is easier to manufacture.

Figure 8:
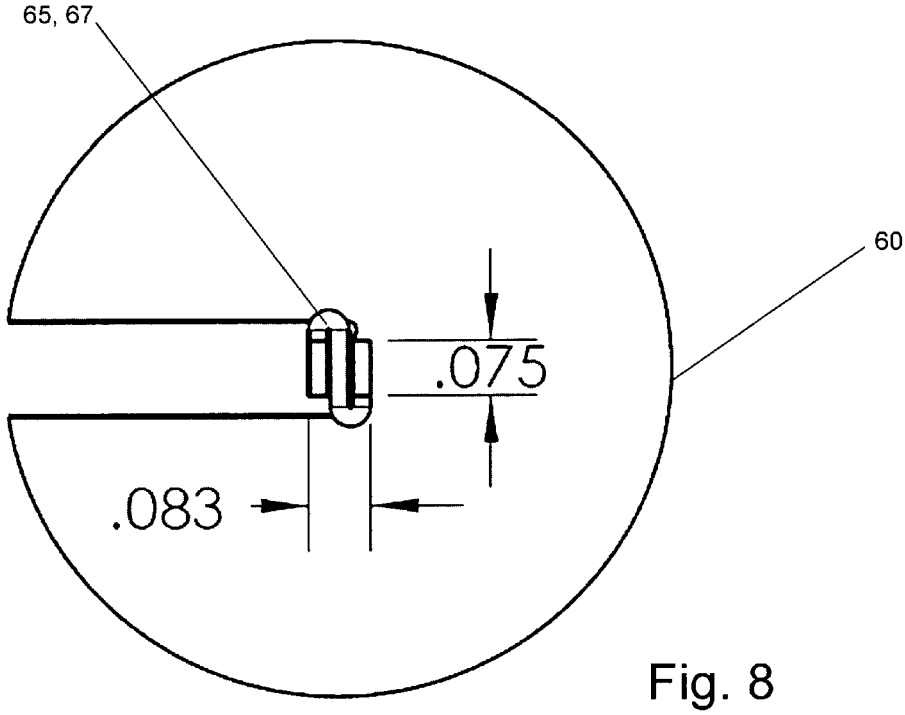
FIG. 8 is a bottom view diagram of another example antenna with radiator.
Figure 9:
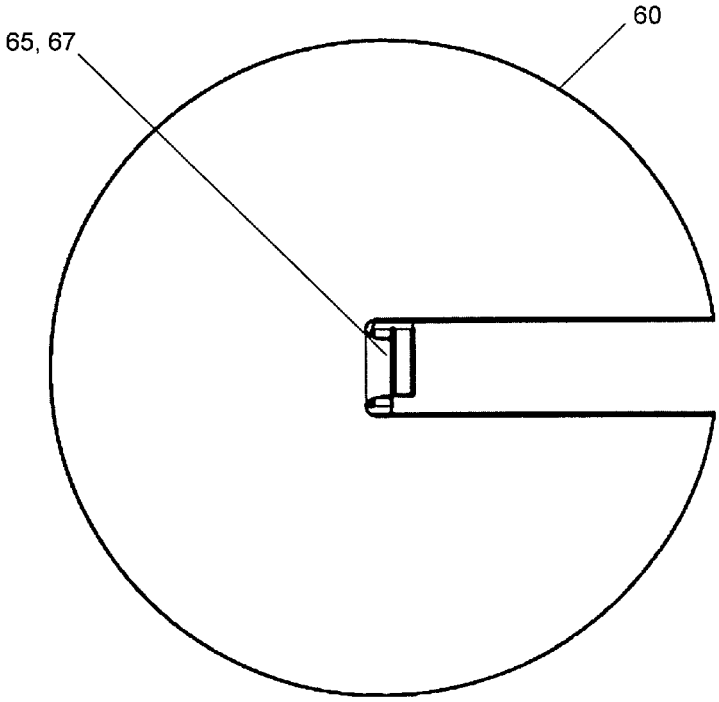
FIG. 9 is a top view diagram of the example antenna of FIG. 8.
Figure 10:
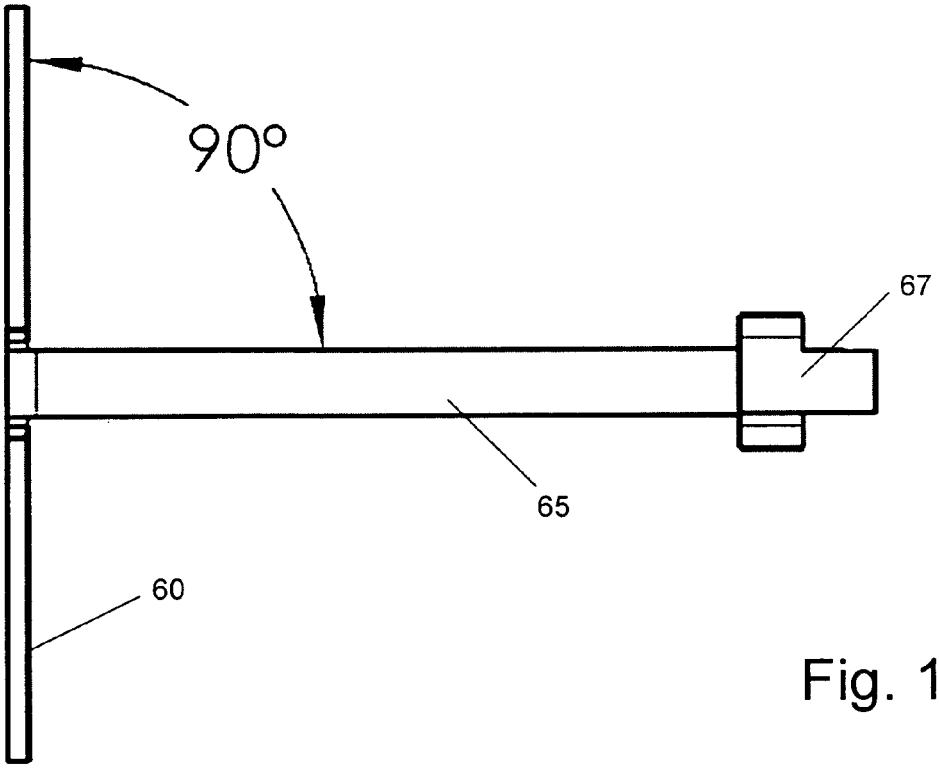
FIG. 10 is a side view diagram of the example antenna of FIG. 8.
Figure 11:
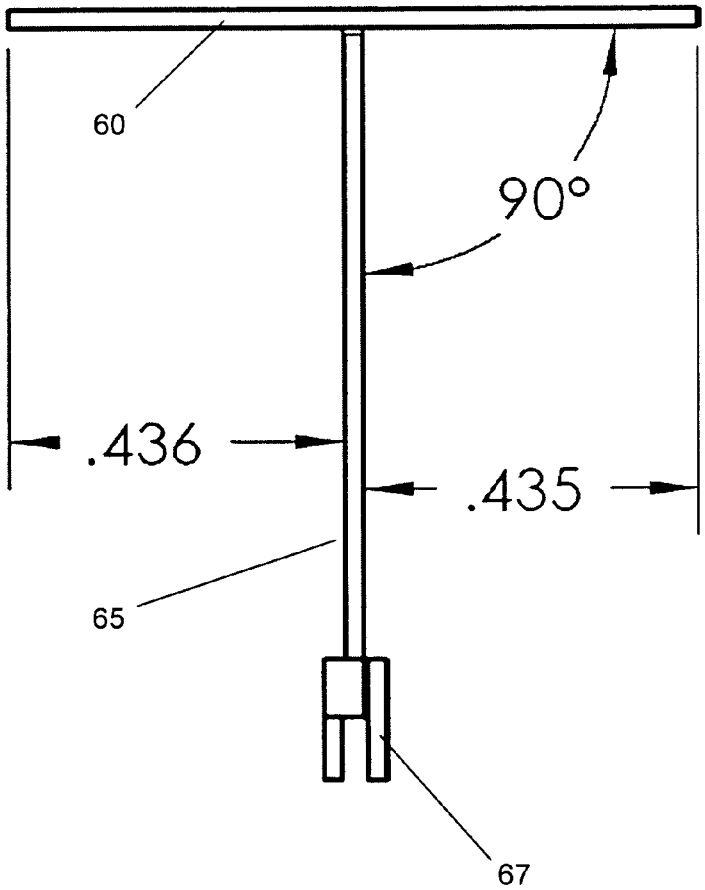
FIG. 11 is another side view diagram of the example antenna of FIG. 8.
Figure 12:
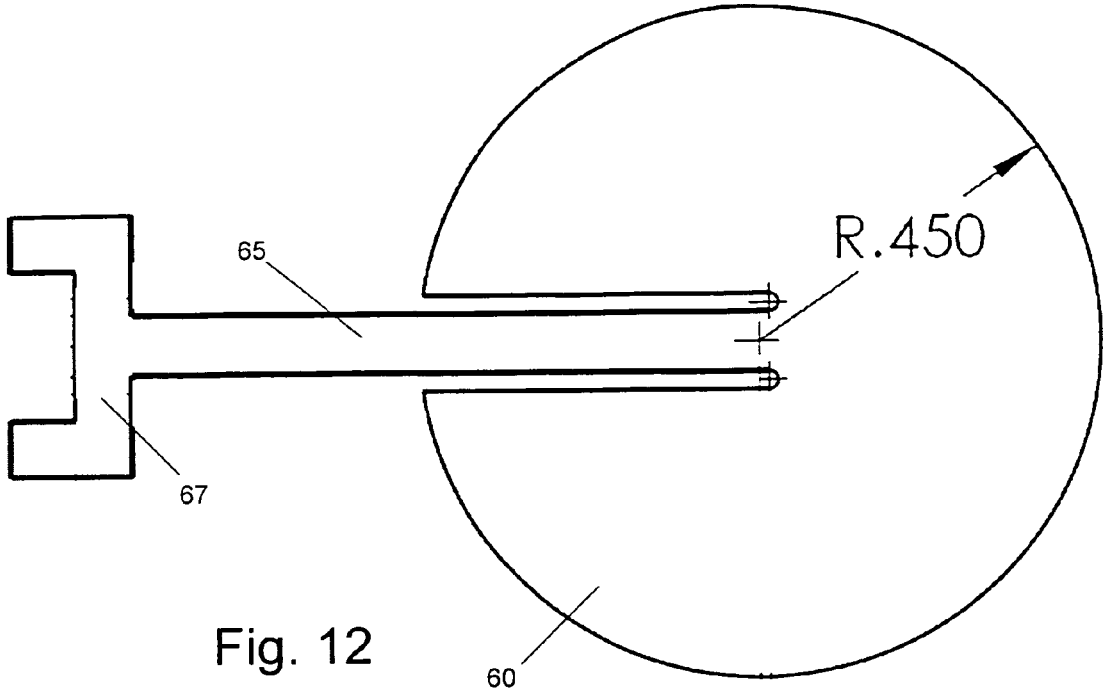
FIG. 12 is a diagram of an example antenna formed of a single sheet of material.
Figure 13:
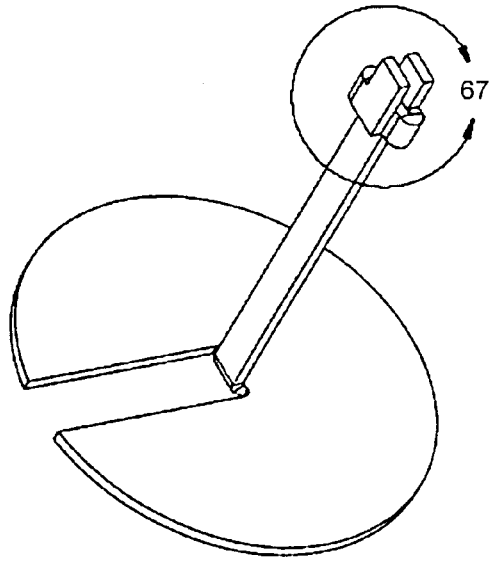
FIG. 13 is a perspective view diagram of the example antenna of FIG. 8.
Figure 14:
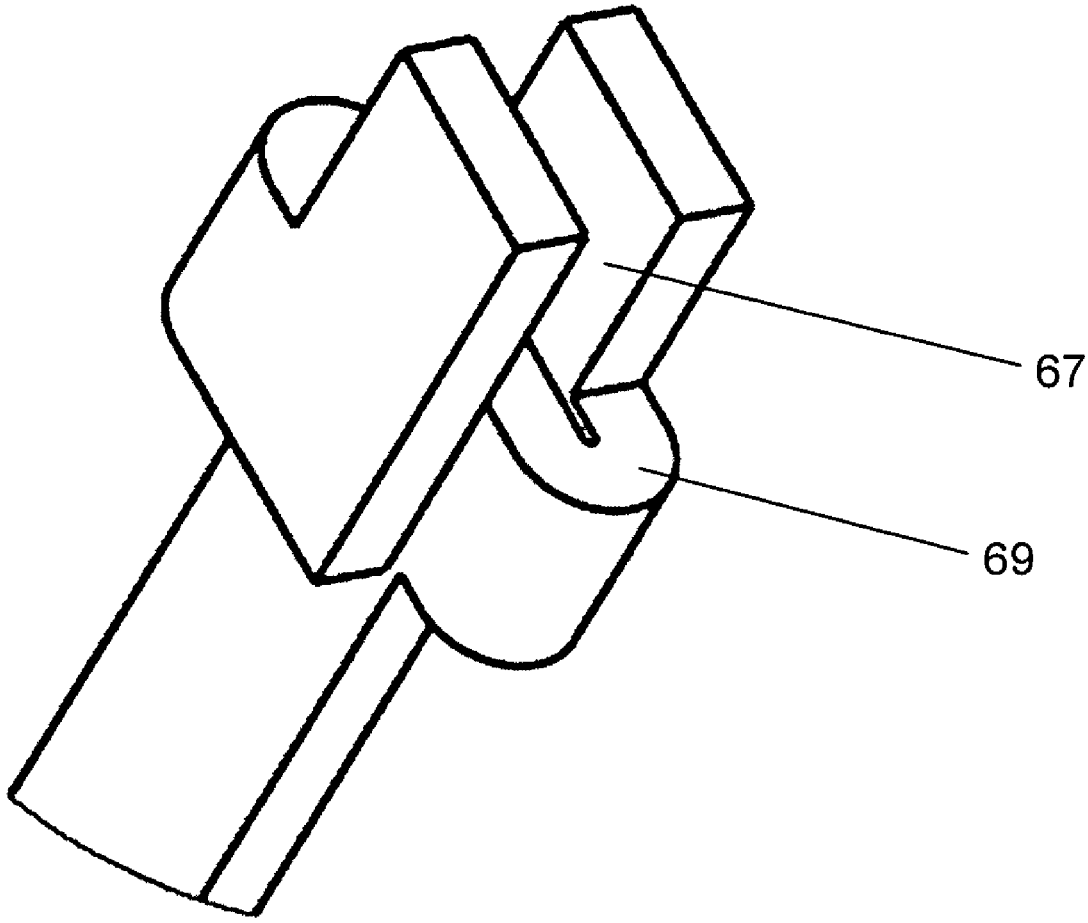
FIG. 14 is a more detailed diagram of an end of the example antenna of FIG. 8.

FIGS. 8-14 show another example antenna with radiator that is stamped from a single sheet of material. Some example dimensions are shown in FIGS. 8, 11, and 12, and are given in inches. FIGS. 8 and 9 show bottom and top views, respectively, of the radiator 60 and pin 65 with connector 67 at the end of the pin 65. Side view diagrams are shown in FIGS. 10 and 11. Desirably, the radiator 60 is at a 90 degree angle with respect to the pin 65. Because the example pin 65 is stamped from a single sheet of material, along with the radiator 60 and connector 67, as shown in FIG. 12, it may be wider on one side than on an adjacent side. After the connector 67 is formed from the single sheet of material, it may be folded or otherwise formed into the desired shape, examples of which are shown in FIGS. 13 and 14.

The pin 55, 65 is desirably formed such that the shape at the circuit board attachment end yields a square or almost square (aspect ratio close to 1) portion that serves as a peg or pin (e.g., element 57 in FIG. 7 and element 67 in FIG. 13) for insertion into a round hole in the circuit board. Preferably, this peg is diametrically flexible enough to facilitate a light press fit into the circuit board hole.

Moreover, the connector 57, 67 desirably has a shoulder (e.g., element 69 in FIG. 14) that limits the insertion depth in the circuit board hole and contributes to the stability of the assembly. Additionally, the peg or pin connector portion may be open by design to the extent that it facilitates subsequent wave soldering to the circuit board, allowing the desired penetration of molten solder into the circuit board hole with the pin or peg inserted.

Consequently, the antenna may be self-fixturing, and desirably supports itself upright or perpendicular to the circuit board in any desired orientation during the soldering operation, and the soldered joint is both mechanically and electrically very substantial.

While the present invention has been described in connection with the preferred embodiments of the various figures, it is to be understood that other similar embodiments may be used or modifications and additions may be made to the described embodiment for performing the same function of the present invention without deviating therefrom.

What is claimed:

1. An antenna assembly comprising:

an antenna, comprising:

a pin; and a disk radiator supported by the pin, wherein the pin is affixed to the radiator at one end and is disposed on a radio frequency (RF) feed point surrounded by a ground plane at the other end, wherein the disk radiator and the pin are stamped from a single sheet of material; and a housing that houses the antenna.

2. The antenna assembly of claim 1, wherein the disk radiator has an opening that receives the pin and the pin fails to project beyond the back surface of the disk radiator.

3. The antenna assembly of claim 1, wherein the antenna is a short monopole antenna.

4. The antenna assembly of claim 1, further comprising an automatic meter reading (AMR) module for water metering, the antenna being disposed therein.

5. The antenna assembly of claim 1, wherein the antenna is mountable through a hole in an iron pit lid.

6. The antenna assembly of claim 1, wherein the antenna is mountable through a hole in a plastic pit lid, or is mountable internally to a plastic lid.

7. The antenna assembly of claim 1, further comprising a potting shield that covers the antenna, wherein the antenna is completely potted while covered with the potting shield.

8. A metering system comprising:

a meter; and an antenna assembly mounted to the meter, the antenna assembly comprising an antenna that comprises:

a pin; and a disk radiator supported by the pin, wherein the disk radiator and the pin are stamped from a single sheet of material.

9. The system of claim 8, wherein the pin is affixed to the radiator at one end and is disposed on a radio frequency (RF) feed point surrounded by a ground plane at the other end.

10. The system of claim 8, wherein the antenna assembly further comprises:

a printed circuit board, the antenna mounted on the printed circuit board; and a housing that encloses the printed circuit board and the antenna.

11. The system of claim 8, wherein the disk radiator has an opening that receives the pin and the pin fails to project beyond the back surface of the disk radiator.

12. The system of claim 8, wherein the antenna is a short monopole antenna.

13. The system of claim 8, wherein the antenna is mountable through a hole in an iron pit lid or in a plastic pit lid.

14. An automatic meter reading module, comprising:

an antenna assembly mounted to a meter, the antenna assembly comprising:

a printed circuit board;

an antenna mounted on the printed circuit board, the antenna comprising a pin and a disk radiator supported by the pin, wherein the pin is affixed to the radiator at one end and is disposed on a radio frequency (RF) feed point surrounded by a ground plane at the other end, and wherein the disk radiator and the pin are stamped from a single sheet of material; and a housing that encloses the printed circuit board and antenna; and a pit lid.

15. The module of claim 14, wherein the antenna is mountable through a hole in the pit lid.

16. The module of claim 14, wherein the pit lid is a plastic pit lid.

17. The module of claim 14, wherein the pit lid is an iron pit lid.

* * * * *